US010273785B2

(12) United States Patent
Older et al.

(10) Patent No.: US 10,273,785 B2
(45) Date of Patent: Apr. 30, 2019

(54) PROCESS FOR REMEDIATING HYDRATES FROM SUBSEA FLOWLINES

(71) Applicant: TRENDSETTER ENGINEERING, INC., Houston, TX (US)

(72) Inventors: David Edward Older, Houston, TX (US); Patrick Michael Cargol, Jr., Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 0 days.

(21) Appl. No.: 15/808,255

(22) Filed: Nov. 9, 2017

(65) Prior Publication Data

US 2018/0135387 A1 May 17, 2018

Related U.S. Application Data

(60) Provisional application No. 62/420,898, filed on Nov. 11, 2016.

(51) Int. Cl.

| | |
|---|---|
| ***E21B 43/01*** | (2006.01) |
| ***E21B 43/12*** | (2006.01) |
| ***E21B 43/36*** | (2006.01) |

(52) U.S. Cl.

CPC ..... *E21B 43/01* (2013.01); *E21B 43/122* (2013.01); *E21B 43/36* (2013.01); *E21B 2043/0115* (2013.01)

(58) Field of Classification Search

CPC ..... E21B 43/01; E21B 43/122; E21B 43/36; E21B 2043/0115

See application file for complete search history.

(56) References Cited

U.S. PATENT DOCUMENTS

| | | | |
|---|---|---|---|
| 5,803,161 | A | 9/1998 | Wahle et al. |
| 6,260,615 | B1 | 7/2001 | Dalrymple et al. |
| 6,415,868 | B1 | 7/2002 | Janoff et al. |
| 6,776,227 | B2 | 8/2004 | Beida et al. |
| 6,939,082 | B1 | 9/2005 | Baugh |
| 7,036,596 | B2 | 5/2006 | Reid |
| 7,234,523 | B2 | 6/2007 | Reid |
| 7,669,659 | B1 | 3/2010 | Older |
| 8,003,573 | B2 | 8/2011 | Ballard et al. |
| 8,424,608 | B1 | 4/2013 | Older |
| 8,430,169 | B2 | 4/2013 | Stoisits et al. |

(Continued)

FOREIGN PATENT DOCUMENTS

WO WO-2017135941 A1 * 8/2017 ..... E21B 23/08

*Primary Examiner* — Matthew R Buck
*Assistant Examiner* — Aaron L Lembo
(74) *Attorney, Agent, or Firm* — Egbert, McDaniel & Swartz, PLLC

(57) ABSTRACT

A process for removing hydrate formations from a flowline includes connecting a manifold to the flowline, passing an inert gas across a pair of inlets of the manifold so as to create a reduced pressure across the pair of inlets that is less than a pressure of a fluid in the flowline, opening a valve between the pair of inlets and the flowline so as to expose the pressurized fluid in the flowline to the reduced pressure across the pair of inlets, disassociating hydrates in the flowline by exposure to the reduced pressure across the pair of inlets, and flowing the fluid and the disassociated hydrates from the flowline into the outlet of the manifold and outwardly of the manifold through at least one of the pair of inlets.

16 Claims, 2 Drawing Sheets

(56) References Cited

U.S. PATENT DOCUMENTS

| | | | | |
|---|---|---|---|---|
| 8,881,843 | B2 * | 11/2014 | Todd | E21B 17/01 166/267 |
| 9,394,169 | B2 * | 7/2016 | McAlister | C01B 3/24 |
| 9,441,452 | B2 * | 9/2016 | Donald | E21B 33/035 |
| 9,470,070 | B2 * | 10/2016 | Keinath | E21B 17/01 |
| 9,644,457 | B2 * | 5/2017 | Sathananthan | E21B 43/017 |
| 2009/0236144 | A1 * | 9/2009 | Todd | E21B 17/01 175/5 |
| 2010/0047022 | A1 | 2/2010 | LeMoign | |
| 2013/0266380 | A1 * | 10/2013 | Capron | F16L 1/24 405/184.4 |
| 2015/0114658 | A1 * | 4/2015 | Donald | E21B 33/035 166/344 |
| 2016/0102531 | A1 * | 4/2016 | Keinath | E21B 17/01 166/367 |
| 2016/0376866 | A1 * | 12/2016 | Donald | E21B 33/035 166/344 |
| 2017/0321517 | A1 * | 11/2017 | Thoresen | E21B 33/0355 |

* cited by examiner

PROCESS FOR REMEDIATING HYDRATES FROM SUBSEA FLOWLINES

CROSS-REFERENCE TO RELATED APPLICATIONS

The present application claims priority from U.S. Provisional Patent Application Ser. No. 62/420,898, filed on Nov. 11, 2016, and entitled "Process for Remediating Hydrates from Subsea Flowlines".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to techniques for remediating hydrate formations in subsea environments. More particularly, the present invention relates to the removal of hydrates from a subsea flowline. More particularly, the present invention relates to gas lift techniques for the disassociation of hydrate formations in subsea flowlines and for the transport of the fluids and disassociated hydrates from the flowline to a surface location.

2. Description of Related Art Including Information Disclosed Under 37 CFR 1.97 and 37 CFR 1.98

More than two-thirds of the earth is covered by oceans. As the petrochemical industry continues its search for hydrocarbons, it is finding that more and more of the untapped hydrocarbon reservoirs are located beneath the oceans. Such reservoirs are referred to as "offshore" or "subsea" reservoirs. A typical system used to produce hydrocarbons from offshore reservoirs uses hydrocarbon-producing wells located on the ocean floor. The producing wells are referred to as "producers" or "subsea production wells". The produced hydrocarbons are transported to a host production facility. The production facility is located on the surface of the ocean or immediately onshore.

The producing wells are in fluid communication with the host production facility via a system of pipes that transport the hydrocarbons from the subsea wells on the ocean floor to the host production facility. This system of pipes typically comprises a collection of jumpers, flowlines and risers. Jumpers are typically referred to in the industry as the portion of pipes that lie on the floor of the body of water. They connect the individual wellheads to a central manifold. The flowline also lies on the marine floor and transports production fluids from the manifold to the riser. The riser refers to the portion of the production line that extends from the seabed, through the water column, into the host production facility. In many instances, the top of the riser is supported by a floating buoy, which then connects to a flexible hose for delivering production fluids from the riser to the production facility.

The drilling and maintenance of remote offshore wells is expensive. In an effort to reduce drilling and maintenance expenses, remote offshore wells are oftentimes drilled in clusters. A grouping of wells and the clustered subsea arrangement is sometimes referred to as a "subsea well-site". A subsea well-site typically includes producing wells completed for production at one or more "pay zones". In addition, a well-site will include one or more injection wells to aid in maintaining in-situ pressure for water drive and gas expansion drive reservoirs.

The grouping of remote subsea wells facilitates the gathering of production fluids into a local production manifold. Fluids from the clustered wells are delivered to the manifold through the jumpers. From the manifold, production fluids may be delivered together to the host production facility through the flowline and the riser. For well-sites that are in deeper waters, the gathering facility is typically a floating production storage and offloading vessel.

One challenge facing offshore production operations is flow assurance. During production, the produced fluids will typically comprise a mixture of crude oil, water, hydrocarbon gases (such as methane), and other gases such as hydrogen sulfide and carbon dioxide. Of equal concern, changes in temperature, pressure and/or chemical composition along the pipes may cause the deposition of other materials, such as methane hydrates, waxes or scales on the internal surface of the flowlines and risers. These deposits need to be periodically removed since buildup of these materials can reduce line size and constrict flow.

Hydrates are crystals formed by water in contact with natural gases and associated liquids. Hydrates can form from hydrocarbons and water at the right temperature and pressure, such as in wells, flowlines, or valves. The hydrocarbons become encaged in ice-like solids which do not flow, but which rapidly grow and agglomerate to sizes that can block flowlines. Hydrates formation most typically occurs in subsea production lines which are at relatively low temperatures and elevated pressures.

The low temperatures and high pressures of a deep water environment cause hydrate formation as a function of the gas-to-water composition. In a subsea pipeline, hydrate masses usually form at the hydrocarbon-water interface, and accumulate as flow pushes them downstream. The resulting porous hydrate plugs have the unusual ability to transmit some degree of gas pressure, while acting as a flow hindrance to liquid. Both gas and liquid may sometimes be transmitted through the plug; however, lower viscosity and surface tension favors the flow of gas.

There are basically four ways known to remediate such hydrate plugs. First, the pressure of the hydrate plug to be changed to a lower pressure, outside the stable range for the hydrates, thereby melting the hydrate. In many instances, it may be difficult to lower the pressure below the hydrate stability pressure. In any event, when the pressure is lowered below the hydrate stability pressure, the decomposition of the hydrate is relatively slow, thereby requiring downtime in the production system for a substantial period of time to remove the hydrate.

Secondly, the temperature of the hydrate can be increased above the hydrate stability temperature. As with the pressure technique described above, raising the temperature of the plug creates the potential for equipment damage and/or personnel safety concerns.

Thirdly, the hydrates can be removed mechanically. While commonly used to remediate hydrate plugs in production wells, this method can be difficult to employ in production equipment and/or pipelines.

Fourthly, it is possible in, and some instances, to inject a chemical, such as alcohol or glycol to dissolve the hydrate. These liquids are effective in melting hydrates and are typically required in relatively large quantities if the plug is extensive. If the plug is a significant distance from the nearest injection location, this method may not be feasible.

In the past, various patents have issued relating to such hydrate remediation activities. For example, U.S. Pat. No. 7,234,523, issued on Jun. 27, 2007 to B. J. Reid, describes a hydraulic friction fluid heater. This method includes pumping a fluid through a length of tubing such that the temperature of the fluid increases. The temperature increase of the fluid is created by friction in the tubing. It can also be created by at least one pressure reducing device, such as an orifice, a pressure reducing valve, or relief valve. A subsea structure may be heated by transferring heat from fluid circulating in a closed loop configuration or by direct application of fluid to the subsea structure by using a nozzle. A remotely-operated vehicle may be utilized to transport some or all of the equipment necessary and to provide power to the pumps used for circulating fluid through the tubing.

U.S. Pat. No. 6,939,082, issued on Sep. 6, 2005 to B. F. Baugh, provides a subsea pipeline blockage remediation method. This method involves the use of a remotely-operated vehicle on the ocean floor to land on and move along a subsea pipeline located above the seafloor. Electrically heated seawater is repeatedly circulated across the outer surface of the pipeline to melt hydrates which have formed on the inside of the pipeline.

U.S. Pat. No. 6,415,868, issued on Jul. 9, 2002 to Janoff et al., teaches a method and apparatus for preventing the formation of alkane hydrates in subsea equipment. This apparatus has at least one flow path through which a well fluid is permitted to flow. The well fluid has a flow temperature and a lower hydrate formation temperature at which hydrates will form in the well fluid. A temperature control device is provided which comprises a housing positioned in heat exchange relationship with respect to the flow path and a phase change material disposed in the housing. The phase change material has a melting point which is below the flow temperature but above the hydrate formation temperature. When the temperature of the phase change material drops to its melting point, the phase change material will solidify and its latent heat will be transferred to the well fluid to maintain the temperature of the well fluid in the flow path above its hydrate formation temperature.

U.S. Pat. No. 5,803,161, issued on Sep. 8, 1998 to Wahle et al., provides a heat pipe heat exchanger for cooling or heating high temperature/high-pressure subsea well streams. This heat exchanger has an annular reservoir surrounding a section of pipeline adjacent the wellhead. One or more heat pipes extend from the annular reservoir into the seawater. In a heat removal configuration, a working fluid is contained within the annular reservoir. The working fluid boils and is evaporated by heat from the wellstream fluid and forms a vapor which rises upwardly into and is condensed within the heat pipes so as to release heat into the surrounding seawater. The recondensed working fluid flows back down into the reservoir to repeat the cycle. In a heat-providing configuration, the working fluid is contained in the heat pipes so as to be boiled by heat transferred from the surrounding seawater. The resulting vapor rises upwardly into the annular reservoir and the heat is transferred to the cooler wellstream fluids.

U.S. Pat. No. 6,776,227, issued on Aug. 17, 2004 to Beida et al., discloses a wellhead heating apparatus and method which serves to prevent freeze-off of wellhead equipment. Radiant heat from a flameless heater is utilized to heat fluid in a heat exchanger, such as a tank or finned radiator. A pump is used to circulate the heated fluid through a conduit loop deployed in thermal contact with the equipment to be heated, such that the heat from the fluid is transferred to the equipment. The equipment is maintained at sufficient temperature to prevent freeze-off.

U.S. Pat. No. 6,260,615, issued on Jul. 17, 2001 to Dalrymple et al., shows a method and apparatus for de-icing oilwells. A power cable is used for heating well bores in cold climates. An electrical switch is located within a wellbore at a selected location in the power cable. The electrical switch is provided to selectively short out the conductors within the power cable so as to allow the power cable above the switch to be used as a resistive heating element to thaw the wellbore.

U.S. Pat. No. 7,036,596, issued on May 2, 2006 B. J. Reid, provides a hydraulic friction fluid heater and method. The method includes pumping a fluid through a length of tubing such that the temperature of the fluid increases. The temperature increase of the fluid is created by friction in the tubing. A subsea structure may be heated by transferring heat from fluid circulating in a closed loop configuration or by direct application of fluid to the subsea structure using a nozzle. A remotely operated vehicle may be utilized to transport the equipment necessary.

U.S. Pat. No. 7,669,659, issued on Mar. 2, 2010 to the present Applicant, teaches a system for preventing hydrate formation in chemical injection piping for subsea hydrocarbon production. This system has a manifold, a production piping communicating with the manifold, a chemical injection line positioned in heat exchange relationship along the production piping, and a fluid delivery system connected to the chemical injection line for passing a heated fluid through at least a portion of the chemical injection line. The chemical injection line has a first portion affixed to a surface of the production piping and a second portion extending outwardly therefrom. The fluid delivery system is in communication with the second portion of the chemical injection line. The chemical injection line extends in a U-shaped pattern or in a spiral pattern around an outer surface of the production piping.

U.S. Pat. No. 8,430,169, issued on Apr. 30, 2013 to Stoisits et al., shows a method for managing hydrates in a subsea production line. The production system includes a host production facility, a control umbilical, at least one subsea production well, and a single production line. The method generally comprises producing hydrocarbon fluids from the production well and through the production line, and then shutting in the production line. The method includes the steps of depressurizing the production line to substantially reduce a solution gas concentration in the produced hydrocarbon fluids, and then re-pressurizing the production line to urge any remaining gas in the free gas phase within the production line back in the solution. The method also includes displacing production fluids within the production line by moving displacement fluids from a service line within the umbilical line and into the production line.

U.S. Pat. No. 8,003,573, issued on Aug. 23, 2011 to Ballard et al., provides a method for remediating flow-restricting hydrate deposits in production systems. In this method, a non-hydrate-forming gas is used to form hydrates at a higher pressure than the existing hydrate through a flow-restricting hydrate.

U.S. Pat. No. 8,424,608, issued on Apr. 23, 2013 to the present Applicant, describes a system and method for remediating hydrates which has a heat storage box with an interior volume, a heater for heating fluid flowing into the hot fluid inlet of the heat storage box, a heat exchanger positioned in the interior volume of the heat storage box so as to be in heat-exchange relationship with heated water from the interior volume of the heat storage box, and a line connected to a heated water outlet of the heat exchanger so as to be manipulated toward a location of the hydrates for the purpose of delivering the heated water toward the hydrates. The heat exchanger is piping extending in a serpentine pattern within an upper portion of the heat storage box.

U.S. Patent Application Publication No. 2010/0047022, published on Feb. 25, 2010 to Y. LeMoign, shows subsea flowline plug remediation. This describes a technique that enables removal of a hydrate plug from a deep water flowline. When the existence of a plug in the flowline is determined, a temporary flowline loop is created to enable repair remedial procedures. The temporary loop is created by deploying a spoolable compliant guide and connecting the spoolable compliant guide to the deepwater flowline. The connection is made in a manner that enables access to both sides of the unwanted plug.

It is an object of the present invention to provide a process for preventing hydrate formation in subsea locations.

It is another object of the present invention to provide a process for remediating hydrate formations that utilizes pressure differentials to disassociate the hydrate formation.

It is another object of the present invention provide a process for remediating hydrates that allows a flow of production fluids to be captured at a surface location.

It is another object of the present invention to provide a process for remediating hydrate formations which is easy-to-use and minimizes time and effort.

These and other objects and advantages of the present invention will become apparent from a reading of the attached specification and appended claims.

BRIEF SUMMARY OF THE INVENTION

The present invention is a process for removing hydrates formations from a flowline. As used herein, the term "flowline" encompasses jumpers, flowlines, pipelines, and similar conduits located in the subsea environment. The process of the present invention includes the steps of: (1) connecting a manifold to the flowline; (2) passing an inert gas across the pair of inlets in the manifold so as to create a pressure across the inlets that is less than a pressure of the fluid within the flowline; (3) opening a valve between the pair of inlets and the flowline so as to expose the pressurized fluid in the flowline to the reduced pressure across the pair of inlets; (4) disassociating the hydrates in the flowline by the exposure to the reduced pressure across the pair of inlets; and (5) flowing the fluid and the disassociated hydrates from the flowline into an outlet of the manifold and outwardly of the manifold through one of the inlets.

In the process the present invention, the manifold has a pair of inlets in valved relation to an outlet and in valved relation to each other. The outlet of the manifold is connected by a conduit to the flowline. Each of the inlets are connected by separate tubings to a supply of an inert gas. In the present invention, the inert gas is preferably nitrogen. The supply of the inert gas can be at a surface location above the manifold. The tubing can be in the nature of coiled tubing.

In the process of the present invention, the fluid and disassociated hydrates will flow toward the inlets because of the reduced pressure across the inlets. In particular, this is accomplished by opening a valve that is connected to the flowline or in the manifold. The hydrocarbons and disassociated hydrates in the flowline will then flow by the pressure of the inert gas toward the surface location. In other words, a pressurized inert gas is delivered down the tubing through one of the inlets of the manifold, passes through toward the other inlet of the manifold, mixes with the fluids and disassociated hydrates from the flowline, and then forces the fluid upwardly through the other tubing toward the surface location by a gas-lift technique.

The method of the present invention further includes closing the valves between the pair of inlets and flowline after the fluid and the disassociated hydrates have been removed from the flowline. The method of the present invention further includes the steps of discharging water from the tubing through an orifice on the manifold. The inert gas is introduced through the tubing so as to discharge the water outwardly through the orifice. The pair of inlets are closed after water is removed from the coiled tubing.

A valve between the pair of inlets and the flowline is opened so that fluid and the disassociated hydrates flow into the water-removed tubing.

In the present invention, the manifold includes a pair of inlets, an outlet, and an orifice. As used herein, the term "inlets" will occasionally function as outlets for the fluid and the inert gas. The "outlet", at times, will function as an inlet for the fluid flowing from the flowline and outwardly of the manifold through one of the inlets. The orifice can be an adjustable choke valve, a needle valve, a throttling valve, or of a similar construction. The orifice is specifically used for adjusting pressures within the manifold and for the discharging of seawater from the tubing by way of the manifold.

In the manifold, a first line therein connects one inlet to the outlet. A second line connects the other inlet to the outlet. The third line connects the first line to the orifice, and a fourth line connects the second line to the orifice. Suitable valves are provided on each of the line so as to control fluid flow within the manifold. The manifold has a conduit connected to the outlet that extends toward the flowline and connected thereto. A first tubing is connected to the first inlet and extends upwardly toward a surface location. A first pump can be cooperative at the tubing so as to create pressures within the first tubing. These a second tubing is connected to the second inlet and extends to a surface location. Another pump is cooperative with the second tubing so as to establish pressures therein. In each of the circumstances, the tubing can be in the nature of a coiled tubing. The supply of inert gas, such as nitrogen, can be provided at a surface location. The pumps are provided so as to introduce the inert gas into the first and second tubings and into the first and second inlets.

In order to establish gas flow from the first inlet toward the second inlet, or vice versa, valves on the third and fourth lines are open so as to establish fluid communication between the inlets. The orifice can be utilized so as to adjust gas flow and pressures. As desired, the flow of fluids and disassociated hydrates can pass outwardly of the manifold through either of the inlets and the tubing associated with such inlet.

This foregoing Section is intended to describe, with particularity, the preferred embodiments of the present invention. It is understood that modifications to these preferred embodiments can be made within the scope of the appended claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
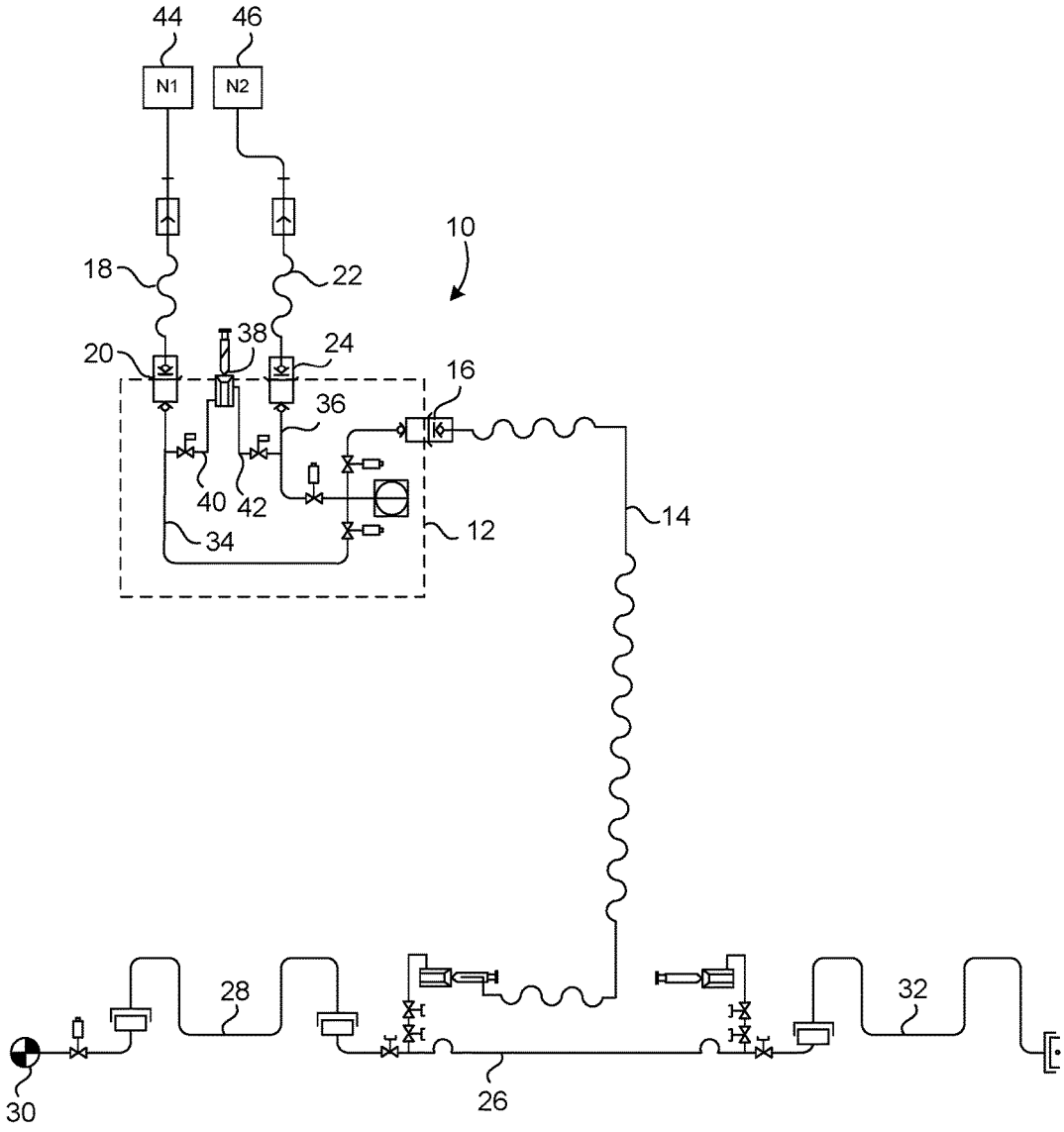
FIG. 1 is a schematic illustration of the process of the present invention.

Referring to FIG. 1, there is shown the process 10 for the removal of hydrates from a subsea flowline. The process 10 utilizes a manifold 12, a conduit 14 connected to an outlet 16 of the manifold 12, a first tubing 18 connected to a first inlet 20 of the manifold 12, a second tubing 22 connected to a second inlet 24 of the manifold 12, and a flowline 26. FIG. 1 shows that the flowline is connected to a well jumper 28 and ultimately to a well 30 by way of various connections. Similarly, the flowline 26 is connected by another jumper 32 to another location at the sea floor.

In FIG. 1, it can be seen that the first inlet 20 is connected by a line 34 to the outlet 16. The second inlet 24 is connected by a line 36 to the outlet 16. An orifice 38 is positioned on the manifold 12 and is cooperative with separate lines 40 and 42 extending respectively between the first inlet 20 and the second inlet 24. Each of these lines has suitable valves thereon so as to control fluid flow. The orifice 38 can be an adjustable choke valve, a needle valve, a throttling valve, or of a similar construction. The orifice 38 can suitably open so as to allow release of fluids into the subsea environment. The orifice 38 can also be utilized for controlling pressures and flow rates of fluids in the various lines. The orifice 38 can be suitably actuated by an ROV or by automatic controls.

The tubing 18 is connected to the first inlet 20 and extends upwardly to a surface location, such as a production vessel. A supply of an inert gas 44 is connected to the tubing 18. A suitable pump can be provided so as to deliver the inert gas through the tubing 18 toward the inlet 20. Another supply of inert gas 46 is connected to the tubing 22 so as to be delivered to the second inlet 24. As used herein, is possible that only a single supply of inert gas be provided in relation to at least one of the tubings 18 and 22. The tubings 18 and 22 are in the nature of coiled tubing that can be supplied from a production vessel.

The conduit 14 can be in the nature of a pipe, a tube, coiled tubing, a jumper, or other type of fluid-passing line. Conduit 14 has one end connected to the outlet 16 of the manifold 12 and another end interconnected to the flowline 26.

The method of the present invention first involves the step of connecting the manifold 12 to the flowline 26. This is established by connecting the conduit 14 to the outlet 16 of the manifold 12 and then connecting the opposite end of the conduit 14 to the flowline 26. In this circumstance, the various valves that connect the outlet 16 to the inlets 20 and 24 are closed. The next step is to pass the inert gas across the pair of inlets 20 and 24 by way of lines 40 and 42 so as to create a pressure across the inlets 20 and 24 that is less than a pressure of the fluid in the flowline 26. Thirdly, a valve within the manifold 12 is opened so as to expose the pressurized fluid in the flowline 26 to the reduced pressure across the pair of inlets 20 and 24. Depending upon which valves are open, this differential pressure will cause fluids to flow from the flowline 26, through the conduit 14, into the outlet 16, and through the lines within the interior of the manifold 12 so as to ultimately pass outwardly of the manifold 12 through one of the inlets 20 or 24. The exposure of the hydrates of the flowline 26 to the reduced pressure across the pair of inlets 20 and 24 will disassociate the hydrates in the manner described herein above. The fluid from the flowline 26, along with the disassociated hydrates, will flow outwardly of the manifold 16 through one of the tubings 18 or 22. In other words, there is a constant flow of inert gas from one of the tubings 18 and 22 toward the other of the tubings 18 and 22. This inert gas flow will create a gas lift so as to force the fluids from the flowline 26 upwardly and outwardly of the manifold 16 so as to be collected by a vessel at the surface of the body of water.

In the present invention, during the installation of the tubings 18 and 22, it is inherent that there will be an accumulation of seawater within these tubings. As such, it is necessary to evacuate the water from the tubings prior to the gas lift of fluids. This is accomplished by opening the orifice 38 and introducing the pressure of the inert gas through each of the tubings 18 and 22. This forces the water out of the interior of the tubings 18 and 22. Once the water is removed from the tubings 18 and 22, the valves can be closed. This will create an ambient pressure of air within the tubings 18 and 22. Since ambient pressure is less than the pressure of the fluid within the flowline 26, when the valves connected to the flowline 26 are opened, this differential pressure will draw the fluids from the flowline 26 into one of the tubings 18 or 22. Once pressure is equalized within the tubing, the pressure of the inert gas can then be introduced so as to force the fluids and disassociated hydrates upwardly and outwardly of the tubing.

Figure 2:
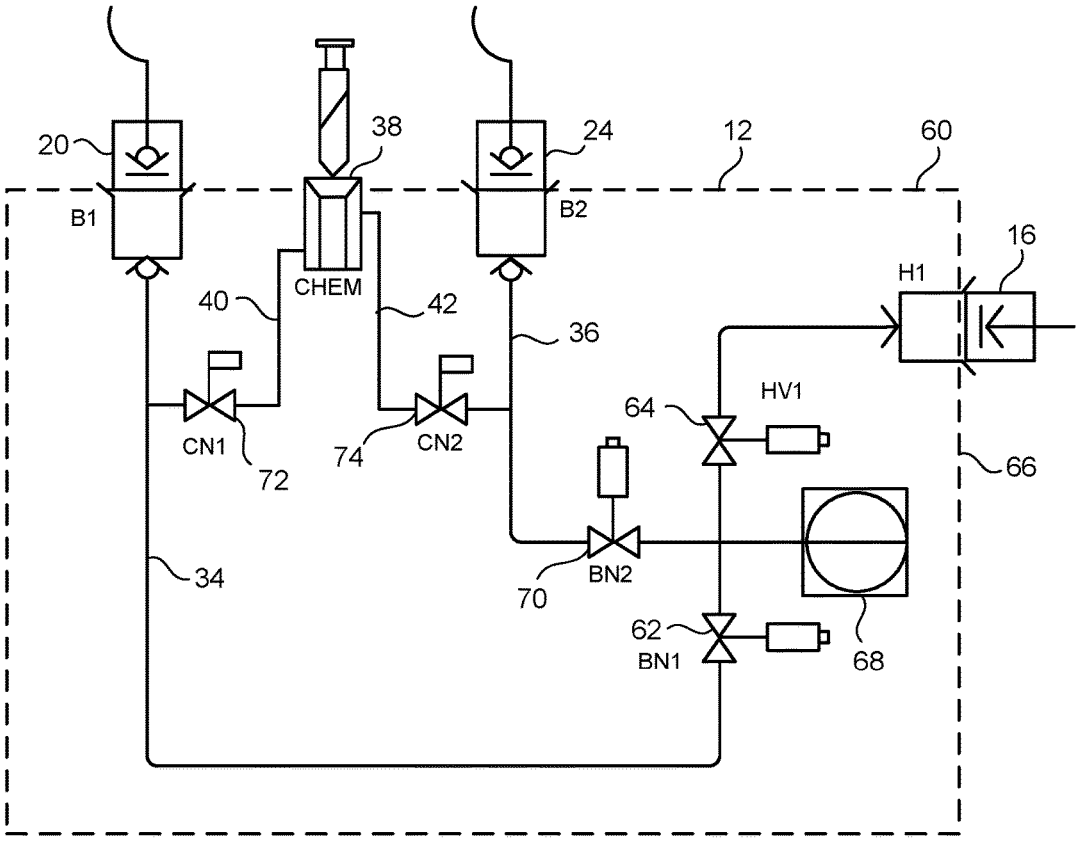
FIG. 2 is a detailed view of the configuration of the manifold is used in the process of the present invention.

FIG. 2 is a detailed view showing the manifold 12. The manifold 12 is designed to be located at a subsea location and proximity to the flowline. As can be seen, the first inlet 20 extends through a wall 60 of the manifold 12. The second inlet 24 also extends through the wall 16 of the manifold 12. Line 34 extends from the first inlet 20 so as to be connected by valves 62 and 64 to the outlet 16. The outlet 16 extends through a wall 66 of the manifold 12. A pressure transducer 68 can be located within the manifold 12 so as to measure pressures within the lines on the interior of the manifold 12.

The second inlet 24 is connected by line 36 to the outlet 16. A valve 70 is positioned on line 36. If it is desired that fluid flow from the inlet 24 should flow to the outlet 16, then valve 70 will be open, valve 64 will be open and valve 62 will be closed. If it is desired to have fluid flow through the inlet 20 and through the line 34 toward the outlet 16, the valves 62 and 64 will be open while the valve 70 remains closed.

The first inlet 20 is connected by line 40 to the orifice 38. The second inlet 24 is connected by line 42 to the orifice 38. A valve 72 is located on line 40 so as to control fluid flow therethrough. Similarly, a valve 74 is located on line 42 so as to control fluid flow therethrough. Ultimately, if it is desired to flow inert gas from inlet 20 toward inlet 24, valves 72 and 74 will be open and the orifice 38 will be open so as to allow fluid flow between the lines 40 and 42.

As described above, the flow of inert gas under a reduced pressure between the inlets 20 and 24 creates a zone of reduced pressure. Ultimately, when the valve 64 is opened and either of the valve 62 and 70 are opened, then the fluid and hydrates within the flowline will be open to a zone of reduced pressure so as to be drawn toward this zone of reduced pressure through the outlet 60, and through the valve 64. If the valve 70 is open, then the hydrocarbons will flow toward the inlet 24 and outwardly therethrough. Alternatively, if the valve 70 is closed and the valve 62 is open, then the hydrocarbons with flow through line 34 and outwardly of the manifold 12 through the inlet 20.

In the present invention, nitrogen, or other gases, serve to remove the bulk fluid column from a riser connected to the subsea equipment. The reduction in pressure allows a hydrate to disassociate (or melt). However, in order to maintain a low-pressure in the system, the fluids (i.e. oil, gas and water) developed from the melting hydrate need to be removed. Other systems have used a subsea pump that is troublesome for high gas volume fluids. This leads to longer disassociation durations. The manifold of the present invention utilizes continuous injection of nitrogen (or similar gas) into the manifold to "gas lift" the fluids back to the intervention vessel.

The manifold has a special features/provisions to facilitate this operation without adding additional down lines. The manifold has the ability to change-out the gas lift injection valve (or orifice) by ROV. It does not need to recover the system.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A process for removing hydrate formations from a flowline, the process comprising:

connecting a manifold to the flowline, the manifold having a pair of inlets and an outlet;

passing an inert gas across the pair of inlets so as to create a reduced pressure across the pair of inlets that is less than a pressure of a fluid in the flow line;

opening a valve between the pair of inlets and the flowline so as to expose the pressurized fluid in the flowline to the reduced pressure across the pair of inlets;

disassociating hydrates in the flowline by exposure to the reduced pressure across the pair of inlets; and flowing the fluid and the disassociated hydrates from the flowline into the outlet of the manifold and outwardly of the manifold through at least one of the pair of inlets.

2. The process of claim 1, further comprising:

connecting the outlet by a conduit to the flowline.

3. The process of claim 1, further comprising:

connecting the pair of inlets to a supply of inert gas by separate tubes.

4. The process of claim 1, the valve being connected to either the flowline or to the manifold.

5. The process of claim 1, the step of flowing comprising:

flowing hydrocarbons and the disassociated hydrates by a pressure of the inert gas toward a surface location.

6. The process of claim 5, the step of flowing further comprising:

flowing hydrocarbons and the disassociated hydrates by a pressure of the inert gas toward a surface location through a coiled tubing.

7. The process of claim 1, further comprising:

closing the valve between the pair of inlets and the flowline after the disassociated hydrates are removed from the flowline.

8. The process of claim 6, further comprising:

removing water from the coiled tubing through an orifice of the manifold by introducing the inert gas through the coiled tubing.

9. The process of claim 8, further comprising:

opening the valve between the pair of inlets and the flowline so as to allow the disassociated hydrates to flow into the water-removed coiled tubing.

10. The process of claim 1, the flowline selected from the group consisting of jumpers, pipelines, conduits and tubing.

11. The process of claim 1, the pair of inlets being in valved relation to the outlet and in valved relation with each other.

12. The process of claim 1, the inert gas being nitrogen.

13. The process of claim 1, further comprising:

supplying the inert gas from a surface location through tubing to the manifold.

14. The process of claim 8, the orifice of the manifold selected from the group consisting of a choke valve, a needle valve, and a throttling valve.

15. The process of claim 1, further comprising:

connecting a first tubing to one of the pair of inlets and extending the tubing to a surface location; and connecting a second tubing to the other of the pair of inlets and extending the second tubing to the surface location.

16. The process of claim 15, further comprising:

pumping the inert gas through the first tubing by a first pump at the surface location; and pumping inert gas through a second tubing by a second pump at the surface location.

* * * * *